United States Patent [19]

Siewert

[11] Patent Number: 4,474,541

[45] Date of Patent: Oct. 2, 1984

[54] INTERNAL CRANKCASE SUPPORT FOR A RADIAL COMPRESSOR

[75] Inventor: Herbert G. Siewert, Sylvania, Ohio

[73] Assignee: Tecumseh Products Company, Tecumseh, Mich.

[21] Appl. No.: 503,276

[22] Filed: Jun. 10, 1983

[51] Int. Cl.[3] ..... F04B 1/04; F16J 10/00

[52] U.S. Cl. ..... 417/273; 92/129; 92/171

[58] Field of Search ..... 92/129, 170, 171; 417/273

[56] References Cited

U.S. PATENT DOCUMENTS

| | | | |
|---|---|---|---|
| 1,820,883 | 8/1931 | Hueber | 417/273 |
| 2,023,609 | 12/1935 | Nelson | 417/273 |
| 2,106,488 | 1/1938 | McCune | 417/273 |
| 2,628,765 | 2/1953 | Anderson . | |
| 2,789,515 | 4/1957 | Smith . | |
| 3,181,437 | 5/1965 | Rumsey et al. . | |
| 3,514,224 | 5/1970 | Budecker . | |
| 3,685,923 | 8/1972 | Hutchins et al. . | |
| 3,692,434 | 9/1972 | Schnear . | |
| 3,777,622 | 12/1973 | Hause et al. . | |
| 3,784,331 | 1/1974 | Heidorn . | |
| 3,910,164 | 10/1975 | Swadner et al. . | |
| 3,945,766 | 3/1976 | Gelon . | |
| 4,050,852 | 9/1977 | Brucken et al. . | |
| 4,273,519 | 6/1981 | Gannaway . | |

*Primary Examiner*—William L. Freeh

*Attorney, Agent, or Firm*—Albert L. Jeffers; John F. Hoffman

[57] ABSTRACT

An internal crankcase support for a radial compressor of the scotch yoke type, especially adapted for use in automotive air-conditioners and having a cast crankcase which is split along a plane axially passing through the center lines of the radially oriented cylinders. Each half of the crankcase has a plurality of radially extending semi-cylindrical recesses which, when assembled, form the cylinders. A steel outer housing encloses the crankcase and serves to form the intake and outlet chambers. The housing is formed of two halves which are joined together along a fluid-tight interface and additionally strengthened by means of a plurality of tie rods which pass through openings in the crankcase and clamp the housing halves tightly together. Internal radial support for the crankcase within the housing is provided by a radial support ring secured to the rear housing section and which, upon assembling the housing halves, tightly fits over a circular crankcase shoulder on the rear crankcase half.

14 Claims, 6 Drawing Figures

INTERNAL CRANKCASE SUPPORT FOR A RADIAL COMPRESSOR

The present invention relates to a split crankcase radial compressor, such as a scotch yoke radial compressor adapted for use in an automotive air-conditioner. Specifically, the invention is related to the external housing assembly, the crankcase therein, and the means for radially supporting the crankcase in the housing.

Automotive air conditioning systems require small, lightweight, compressors which can be conveniently mounted to the engine and driven by the same belt system that drives the fan, alternator and power steering pump. One compressor which has been found to meet these requirements is a radial compressor wherein a plurality of pistons are reciprocated within cylinders radially disposed about the crankshaft.

One problem with this type of compressor is the difficulty of assembling the pistons to the crankshaft and crankcase. A prior art approach is to insert the pistons through the cylinders and then press fit them to the yoke assembly. A more satisfactory technique is disclosed in U.S. Pat. No. 3,910,164, which discloses a radial compressor wherein the crankcase is split, with each of the two halves including a plurality of semi-cylindrical cross recesses. The piston assembly is placed in one of the crankcase halves and then the other half if secured thereto. An improvement to this basic type of compressor is disclosed in U.S. Pat. No. 4,273,519, which is incorporated by reference herein and is owned by the assignee of the present invention. The compressor which is the subject of that patent solves the problem of providing a good seal between the crankcase halves by preassembling the pistons with stamped steel cylinder liners prior to assembly with the crankcase. The liners serve to align the two crankcase halves, maintain proper clearances, and provide the desired compatibility for wear against the aluminum pistons.

In the compressor disclosed in the aforementioned U.S. Pat. No. 4,273,519, an external housing, which is also of a two-piece construction, encloses the crankcase and forms the intake and outlet chambers. A significant problem in the construction of a lightweight automotive compressor incorporating such a housing is that of obtaining sufficient strength in the housing to withstand burst pressure levels. To rely only on the weld around the interface of the housing halves may not be satisfactory to meet standards. This particular problem is solved by the invention disclosed in U.S. Pat. No. 4,316,705, which is incorporated herein by reference and is assigned to the assignee of the present invention, by incorporating tie rods which are rigidly connected to the housing halves as by welding, riveting, etc.

In the compressor disclosed in U.S. Pat. No. 4,316,705, it has been discovered that the moment force exerted by the belt-pulley assembly on the crankcase and tie rods has created undesirable stresses near the connection of the tie rods to the housing. The moment force exerted by the belt-pulley assembly is applied in a generally radial direction relative to the axis of rotation of the crankshaft and causes the housing to deform in an S-shaped manner.

SUMMARY OF THE INVENTION

The present invention substantially eliminates the undesirable stresses exerted by the belt-pulley assembly on the housing by providing radial support to the crankcase within the housing. This is accomplished in cooperation with a circular crankcase shoulder, which houses an O-ring seal against the rear housing section, by a radial support ring attached to the inner surface of the rear housing section. The radial support ring has an internal diameter just slightly greater than the external diameter of the crankcase shoulder and, upon compressor assembly into the housing, the crankcase shoulder tightly nests inside the radial support ring, thereby substantially eliminating the flexure of the front housing section caused by moment forces exerted by the belt-pulley assembly. This results in normal stress levels which are below the front housing section and tie rod fatigue limits and, consequently, prolongs the life of the compressor.

Modifications of the above preferred embodiment are contemplated, one of which substitutes the radial support ring with four radial support ribs attached to the rear housing section such that the ribs are circumferentially spaced apart from each other approximately 90°. Assembly of the compressor within the housing is accomplished as earlier mentioned so that the crankcase shoulder nests within the four radial support ribs.

In a second modification, a second radial support ring has a plurality of openings therein for slidably receiving therethrough respective tie rods and is fitted over the crankcase shoulder. Thereafter, the tie rods are received through openings in the rear housing section and secured thereto.

Specifically, the present invention contemplates a housing assembly for use in a radial compressor of the type including a crankcase having a plurality of radially oriented cylinders therein, a crankshaft received in the crankcase and positioned centrally of the cylinders, and pistons connected to the crankshaft and received in the cylinders for reciprocating movement. The housing for the crankcase, comprises two halves mated together along a fluid-typed interface, and a plurality of tie rods extend through the crankcase and are connected to the housing halves at their opposite ends to clamp the housing halves tightly together. The improvement comprises a circular shoulder member disposed on either the housing inner surface or the crankcase and which has at least one support surface circumferentially disposed around the axis of rotation of the crankshaft and is radially intermediate between the axis and the distal ends of the cylinders, and a support member disposed on the other of the housing inner surface or crankcase for engaging the above-mentioned support surface to radially support the crankcase in the housing against movement in all directions generally perpendicular to the crankshaft axis, thereby substantially preventing the crankcase from exerting radial forces on the tie rods and housing.

It is an object of the present invention to provide radial support to the crankcase against moment forces exerted by the belt-pulley assembly, thereby substantially eliminating deformation of the housing caused by the moment forces.

BRIEF DESCRIPTION OF THE DRAWINGS

The above mentioned and other features and objects of this invention, and the manner of attaining them, will become more apparent and the invention itself will be better understood by reference to the following description of the invention taken in conjunction with the accompanying drawings, wherein.

DETAILED DESCRIPTION OF THE PREFERRED EMBODIMENT

Figure 1:
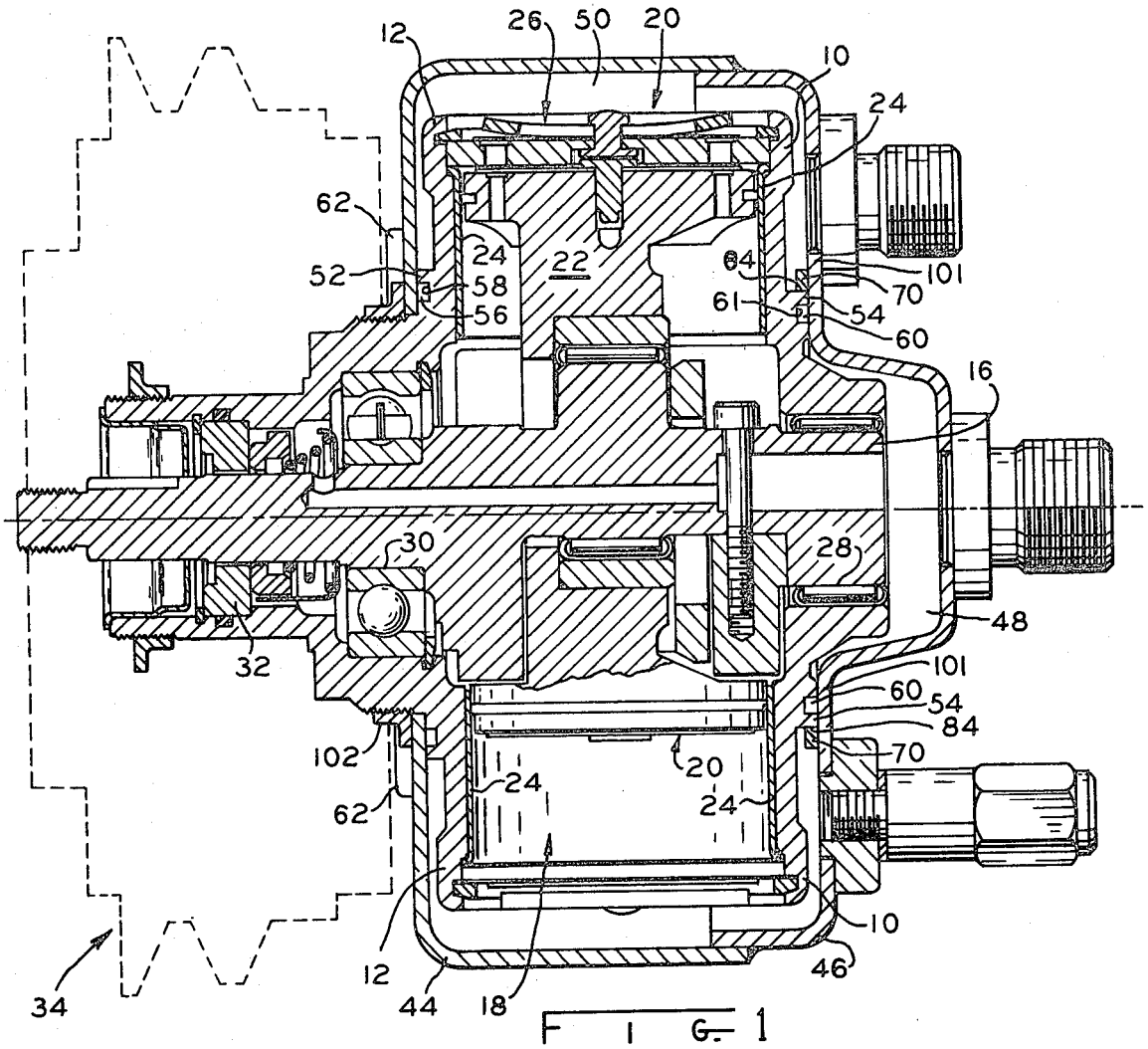
FIG. 1 is a sectional view of a scotch yoke radial compressor incorporating a preferred embodiment of the present invention.
Figure 2:
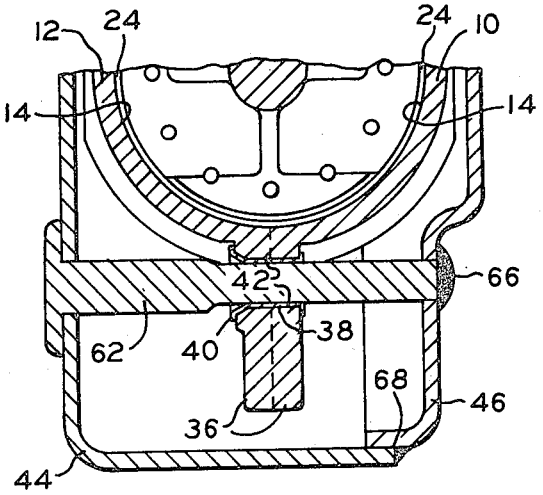
FIG. 2 is a fragmentary, broken-away view of the compressor of FIG. 1 showing a tie rod and tubular rivet assembly.

Referring now to FIGS. 1 and 2, the compressor according to the present invention comprises a pair of cast aluminum crankcase halves 10, 12, with each of the halves 10 and 12 including semi-cylindrical recesses 14 therein. Semi-cylindrical recesses 14 are positioned with their axes running perpendicular to the axis of crankshaft 16, and when the two crankcase halves 10 and 12 are assembled, the recesses 14 form cylinders within which the cylinder liners 2½ are received Pistons 20 are part of a pair of integral, double-ended piston yoke elements 22, and are inserted within respective stamped steel cylinder liners 24, which are generally cylindrical in shape. Also shown in FIG. 1 is one of four valve arrangements 26 on cylinder liner 24. Crankshaft 16 is rotatably received within bearing 28 in crankcase half 10, bearing 30 in crankcase half 12, and seal plate 32, which prevents leakage of refrigerant through the bearings and belt-pulley assembly 34, shown in dotted lines. A more detailed description of valve arrangements 26 may be found in U.S. Pat. No. 4,316,705, which has been earlier incorporated by reference herein.

Each of the crankcase halves 10 and 12 includes web portions 36, which are in face-to-face abutment when crankcase halves 10, 12 are assembled. Crankcase halves 10, 12 are connected together by means of tubular eyelet rivets 38 (FIG. 2), each of which includes an enlarged head portion 40. Each of the rivets 38 extends through openings 42 in web portions 36 which are in alignment when crankcase halves 10, 12 are assembled with enlarged head portions 40 abutting web portions 36. The opposite ends of rivets 38 are then clinched so as to tightly secure crankcase halves 10 and 12 together and to seal the interface therebetween. Again, a more detailed description of rivets 38 is disclosed in U.S. Pat. No. 4,316,705.

The assembled crankcase is enclosed by a housing assembly comprising a front housing section 44 and a rear housing section 46, each of which is of stamped steel construction, and together serve to form intake chamber 48 and discharge chamber 50. Front housing section 44 abuts against belt-pulley assembly 34 and is captured between front nut 102 and circular crankcase shoulder 52, and rear housing section 46 abuts against a second circular crankcase shoulder 54 disposed on crankcase half 10.

O-ring seal 56 in groove 58 formed by circular crankcase shoulder 52 seals the interface between front housing section 44 and crankcase half 12, and O-ring 60, which is compressed between rear housing section 46 and the rear surface of crankcase section 10 in groove 61, serves to seal intake chamber 48 from discharge chamber 50, the latter being formed between housing sections 44, 46 and crankcase halves 10, 12.

Figure 3:
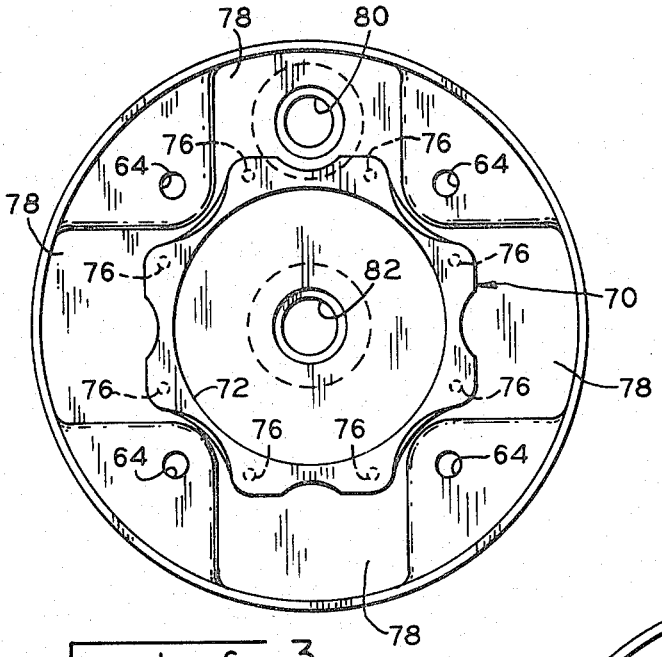
FIG. 3 is an elevational view of the interior of the rear housing section illustrating therein the radial support ring of a preferred embodiment of the present invention.

Housing sections 44, 46 are held together by means of four steel tie rods 62, only one of which is illustrated in FIG. 2, which are welded to housing front section 44, extend through tubular rivets 38, and extend through openings 64 in rear housing section 46 (FIG. 3). With housing sections 44, 46 being held tightly together, welds 66 between tie rods 62 and rear housing section 46 retain the assembly in place. Front and rear housing sections 44, 46 are also welded together at 68 around the entire perimeter of their mutual interface. Although tie rods 62 have been shown as being welded in place, other fastening techniques may be utilized as long as the interior of housing 44, 46 remains sealed.

Referring now to FIG. 3, radial support of crankcase halves 10, 12 within housing sections 44, 46 to prevent the undesired exertion of radial moment forces against tie rods 62 by belt-pulley assembly 34 is provided by a radial support ring 70. Radial support ring 70 has a cylindrically-shaped containment surface 72, and eight weld projections 76 are disposed on the inner surface of recesses 78 in rear housing section 46. Radial support ring 70 is then secured to rear housing section 46 by welding at weld projections 76. Also illustrated in FIG. 3 is discharge outlet 80 communicating with discharge chamber 50 and suction inlet 82 communicating with intake chamber 48.

Referring back to FIG. 1, radial support ring 70 is secured to rear housing section 46 prior to mating rear housing section 46 with housing section 44. Upon assembling rear housing section 46 with front housing section 44, circular crankcase shoulder 54, which has shoulder support surface 84, is fitted within radial support ring 70 such that shoulder support surface 84 is in abutting engagement with containment surface 72. Consequently, during operation, the compressor's radial movement is restricted by shoulder support surface 84 and containment surface 72.

Figure 4:
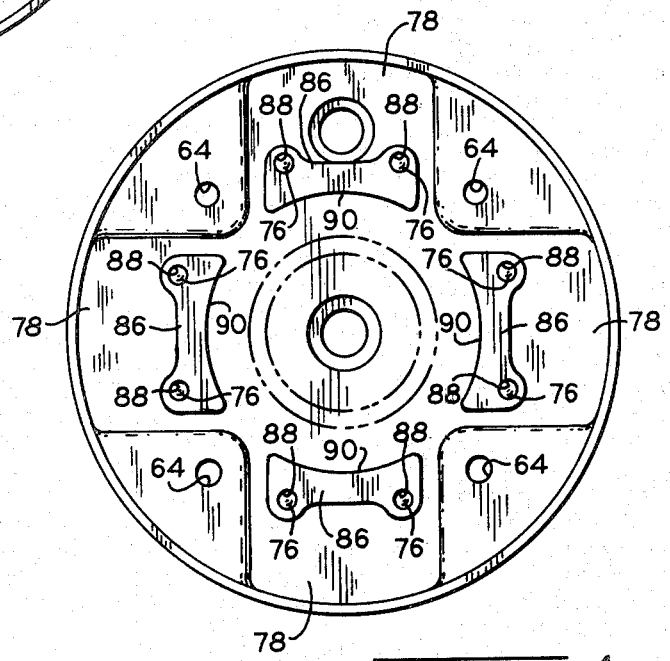
FIG. 4 is an elevational view of the interior of the rear housing section illustrating four radial support ribs of a second embodiment of the present invention.
Figure 5:
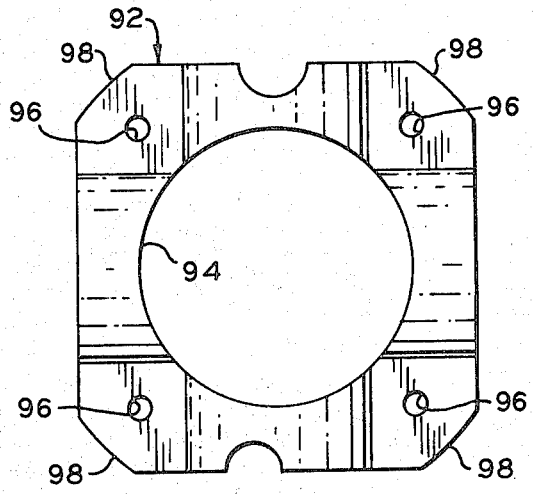
FIG. 5 is an elevational view of a second radial support ring of a third embodiment of the present invention.
Figure 6:
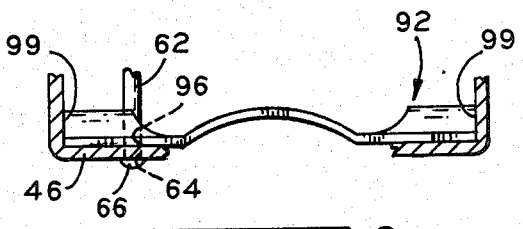
FIG. 6 is a fragmentary, broken-away view illustrating the placement of the second radial support ring within the rear housing section.

FIG. 4 illustrates a modification of radial support ring 70 wherein four radial support ribs 86 are substituted therefor. Each radial support rib 86 is placed in a respective recess 78 and secured thereto by welding weld projections 76 received through holes 88 in radial support rib 86. Further, each radial support rib 86 has its own containment surface 90 in abutting engagement with shoulder support surface 84. When four radial support ribs 86 are substituted for radial support ring 70, it is important that the four ribs 86 be equally spaced in circumferential alignment by approximately 90°. Generally, this requirement is met by recesses 78 which are angularly spaced apart from each other by approximately 90 °. Referring now to FIGS. 5 and 6, another modification is illustrated by second radial support ring 92. Ring 92 has containment surface 94, which has a diameter just slightly greater than the diameter of shoulder support surface 84, four openings 96 through which respective tie rods 62 are received, and four peripheral surface sections 98, which are shaped to abut against the inner surface 99 of rear housing section 46 (FIG. 6). One of the advantages of this particular radial support ring 92 is that it may be installed before assembling rear housing section 46 to front housing section 44. Note that radial support ring 92 is not welded to rear housing section 46, but rather is maintained in position by tie rods 62 being received through respective openings 96. As above, when radial support ring 92 is received on tie rods 62, containment surface 94 is fitted over and against shoulder support surface 84.

It should also be realized that radial support ring 70, radial support ribs 86, and radial support ring 92 are manufactured to conformingly fit against the inner surface of rear housing section 46.

In operation, as crankshaft 16 is rotated by belt-pulley assembly 34, a slide block (not shown) will cause pistons 20 to reciprocate within their respective cylinders 18 so as to draw gas into the cylinders 18 from intake chamber 48 and discharge the compressed gas into discharge chamber 50. Incoming gas is brought into intake chamber 48 through suction inlet 82, and the high pressure discharge gas is delivered to the refrigeration system condenser (not shown) through discharge outlet 80. During this operation, the moment forces exerted in a radial direction by belt-pulley assembly 34 against front housing section 44 and tie rods 62 is substantially eliminated by the radial support provided to crankcase halves 10, 12 in housing sections 44, 46 by radial support ring 70, radial support ribs 86, or radial support ring 92. By substantially eliminating these radial moment forces, deformation or flexture of front housing section 44 is kept within the stress limits of front housing section 44 and tie rods 62.

A factor which contributes to the rigid support of crankcase 10, 12 is that ring 70 (FIG. 3) and ribs 86 (FIG. 4) are fastened to a wall 101 of rear housing section 46 that is oriented generally radially. Therefore, the forces exerted on ring 70 tend to stress rear housing section 46 in the direction in which it has the most resistance to stress, thereby resulting in a very rigid support for crankcase 10, 12.

While this invention has been described as having specific embodiments, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A radial compressor comprising:

a crankcase having a plurality of radially oriented cylinders therein, a crankshaft received in said crankcase and positioned at the common center of said radially oriented cylinders, said crankshaft being rotatable about an axis located at the common center of said radially oriented cylinders, a plurality of pistons connected to said crankshaft and received in respective said radially oriented cylinders for reciprocative movement, a housing enclosing said crankcase and comprising two halves mated together along a fluid-tight interface peripherally disposed about said crankcase, said housing having an inner surface, a plurality of tie rod means extending within said housing and through said crankcase and being connected to said housing halves to clamp said housing halves together, a shoulder member disposed on one of said housing inner surface and said crankcase, and having a support surface means circumferentially disposed around the axis of rotation of said crankshaft and being radially intermediate the axis of rotation of said crankshaft and the distal ends of said radially oriented cylinders, and means disposed on the other of said housing inner surface and said crankcase for engaging said support surface means to radially support said crankcase in said housing against movement in all directions generally perpendicular to the crankshaft axis to thereby substantially prevent said crankcase from exerting radial forces on said tie rod means and said housing.

2. The compressor of claim 1 wherein said crankcase is of the split-type comprising two halves joined together at an interface axially intersecting said cylinders.

3. The compressor of claim 1 wherein said shoulder member is disposed on said crankcase and said engaging means is disposed on said housing inner surface.

4. The compressor of claim 3 wherein said engaging means is a single-piece ring-shaped member having a containment surface in engaging abutment with said support surface means of said shoulder member.

5. The compressor of claim 3 wherein said engaging means is a plurality of rib members disposed about the crankshaft axis and having a respective plurality of containment surfaces, said containment surfaces being in circumferential alignment with each other relative to the crankshaft axis and in engaging abutment with said support surface means.

6. A radial compressor comprising:

a crankcase having a plurality of radially oriented cylinders therein, a crankshaft received in said crankcase and positioned at the common center of said radially oriented cylinders, said crankshaft being rotatable about an axis located at the common center of said radially oriented cylinders, a plurality of pistons connected to said crankshaft and received in respective said radially oriented cylinders for reciprocative movement, a housing enclosing said crankcase and comprising two halves mated together along a fluid-tight interface peripherally disposed about said crankcase, said housing including a generally radially extending wall having an inner surface, a plurality of tie rod means extending within said housing and through said crankcase, and being connected to said housing halves to clamp said housing halves together, a shoulder member disposed on one of said housing inner surface and said crankcase and having support surface means circumferentially disposed around the axis of rotation of said crankshaft and being radially intermediate the axis of rotation of said crankshaft and the radial extent of the distal ends of said radially oriented cylinders, and means supported by said tie rod means between said housing inner surface and said crankcase for engaging said support surface means to radially support said crankcase in said housing against movement in all directions generally perpendicular to the crankshaft axis to thereby substantially prevent said crankcase from exerting radial forces on said tie rod means.

7. The compressor of claim 6 wherein said engaging means is a single-piece ring-shaped member having a containment surface in engaging abutment with said support surface means of said shoulder member and a plurality of openings therein, and wherein each said tie rod means is a metallic rod-like member received through a respective said opening to support said single-piece ring-shaped member between said housing inner surface and said crankcase.

8. In a radial compressor of the type including a crankcase having a plurality of radially oriented cylinders therein, a crankshaft received in said crankcase and positioned at the common center of said radially oriented cylinders and being rotatable about an axis located at the common center of said radially oriented cylinders, a plurality of pistons connected to said crankshaft and received in respective said radially oriented cylinders for reciprocative movement, a housing enclosing said crankcase and including two halves joined together along a fluid-tight interface peripherally disposed around the axis of rotation of said crankshaft, said housing having an inner surface, and a plurality of tie rod means extending within said housing and through said crankcase and being connected to said housing halves to clamp said housing halves together, the improvement comprising:

a support member disposed on and contained by said housing inner surface and having a support surface means circumferentially disposed around the axis of rotation of said crankshaft, said support surface means being radially nearer the axis of rotation of said crankshaft than are the distal ends of said radially oriented cylinders, and means on said crankcase and in abutment against said support surface means for supporting said crankcase in said housing to substantially prevent said crankcase from exerting forces on said tie rod means.

9. The compressor of claim 8 wherein said shoulder member is integral with said crankcase and said supporting means is loosely disposed on said housing inner surface.

10. The compressor of claim 8 wherein said supporting means is a plurality of rib members disposed about the crankshaft axis, each said rib member having a containment surface, said containment surfaces being in equally-spaced circumferential alignment with each other relative to the crankshaft axis and in engaging abutment with said support surface means.

11. The compressor of claim 9 wherein said supporting means is a single-piece ring-shaped member having a containment surface in engaging abutment with said support surface means of said shoulder member.

12. The compressor of claim 11 wherein said ring-shaped member has a plurality of openings therein, and each said tie rod means is a metallic rod-like member received through a respective said opening.

13. A compressor comprising:

a crankcase, a housing enclosing said crankcase and defining a discharge chamber between said crankcase and said housing, means within said crankcase for compressing a fluid and discharging the compressed fluid into said discharge chamber, said housing comprising a first section and a separate second section mating with said first section along a fluid-tight interface, said housing having an inner surface, a plurality of tie rod means each connected at one end to one of said housing sections and connected at the other end to the other housing section so as to rigidly connect said housing sections together, said tie rod means extending through said discharge chamber, an arcuately-shaped support member disposed on one of said housing inner surface and said crankcase radially inwardly of the periphery of said housing, and means on the other of said housing inner surface and said crankcase for engaging said arcuately-shaped support member to support said crankcase in said housing to lessen the forces exerted by said crankcase on said rod means.

14. The compressor of claim 13 wherein each said tie rod means is a metallic rod-like member and generally parallel to the others, and said support member lies in a plane generally perpendicularly disposed to said metallic rod-like members.

* * * * *